US008342877B2

(12) United States Patent
De Bruijn et al.

(10) Patent No.: US 8,342,877 B2
(45) Date of Patent: Jan. 1, 2013

(54) CABLE CONNECTOR AND CABLE CLAMP

(75) Inventors: Jeroen De Bruijn, Loon op Zand (NL); Nico Van Stiphout, Beek en Donk (NL); Ton Karsmakers, Oss (NL); Gert Droesbeke, Geel (BE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/735,271

(22) PCT Filed: Dec. 17, 2008

(86) PCT No.: PCT/EP2008/067800

§ 371 (c)(1),
(2), (4) Date: Jun. 28, 2010

(87) PCT Pub. No.: WO2009/083461

PCT Pub. Date: Jul. 9, 2009

(65) Prior Publication Data

US 2010/0285688 A1 Nov. 11, 2010

(30) Foreign Application Priority Data

Jan. 2, 2008 (WO) ..... PCT/IB2008/051260

(51) Int. Cl.
*H01R 13/58* (2006.01)

(52) U.S. Cl. ..... 439/460; 439/470

(58) Field of Classification Search ..... 439/460, 439/465, 470–472
See application file for complete search history.

(56) References Cited

U.S. PATENT DOCUMENTS

| | | | | |
|---|---|---|---|---|
| 3,029,405 | A | 4/1962 | Buchanan | 339/14 |
| 3,858,960 | A | 1/1975 | Kunkle et al. | 339/103 |
| 3,907,396 | A | 9/1975 | Huber | 339/103 R |
| 6,109,954 | A * | 8/2000 | Lin | 439/460 |
| 6,358,091 | B1 | 3/2002 | Lo et al. | 439/608 |
| 7,371,106 | B2 * | 5/2008 | Nad | 439/470 |
| 7,432,452 | B2 * | 10/2008 | Gardner | 174/650 |
| 7,549,891 | B2 * | 6/2009 | Mossner et al. | 439/404 |
| 7,621,772 | B1 * | 11/2009 | Tobey | 439/460 |
| 2004/0214479 | A1 | 10/2004 | Bartok | 439/790 |

FOREIGN PATENT DOCUMENTS

| | | |
|---|---|---|
| DE | 297 11 253 U1 | 7/1998 |
| DE | 101 46 119 C1 | 12/2001 |
| GB | 598071 | 2/1948 |
| WO | WO 03/067718 A1 | 8/2003 |

* cited by examiner

*Primary Examiner* — Thanh Tam Le
(74) *Attorney, Agent, or Firm* — Harrington & Smith

(57) ABSTRACT

Cable connector including a connector housing and a cable clamp for clamping a cable to the housing. The cable clamp having an intermediate portion between a first and a second mounting portion. At least one of the two mounting portions of the cable clamp is provided with locking means selectively cooperative with at least two matching locking means, such as slots, of the connector housing to hold the cable clamp in respective different positions corresponding to different cable diameters.

11 Claims, 7 Drawing Sheets

CABLE CONNECTOR AND CABLE CLAMP

FIELD OF THE DISCLOSURE

The present invention relates to the field of connectors, in particular electrical cable connectors.

BACKGROUND OF THE DISCLOSURE

In the field of connectors, in particular cable connectors, it is known to use a cable clamp, clamping the cable to the connector housing, for strain relief. Generally, the cable clamp is screwed to the housing. This requires screws, thus additional separate parts, and the screwing complicates assembly of the connector.

The connector housing and/or the cable clamp generally are formed providing an opening optimized for receiving a cable of a particular outer diameter and compressibility. Such connectors are not well suited for accommodating a cable of a different diameter and/or compressibility.

If the opening for the cable is small, portions of the cable may be pinched or crushed, which affects its transmissive and/or structural properties. This is in particular the case for cables for signal transmission, especially high speed signal transmission, and for multi-wire cables. Conversely, a large cable opening may allow slipping of the cable with respect to the housing, possibly affecting or compromising connections of and/or to the cable inside the housing. Thus, connectors having a cable clamp may have limited usefulness for many purposes. As a result, stocking and/or selling various sizes and types of connector housings and/or cable clamps for suitably clamping different cables is required. This substantially increases costs.

Therefore, a need exists for an improved cable connector reducing or alleviating the above-referenced problems.

SUMMARY OF THE DISCLOSURE

An object of the present invention is to provide a cable clamp that can be used for different cable diameters. This object is achieved with a cable connector comprising a connector housing with an opening for receiving a cable, and a cable clamp mounted to the connector housing wherein the clamp comprises an intermediate section between two or more mounting portions, at least one of the mounting portions comprising locking means for interlocking with one of at least two cooperative locking means of the housing. When the cable clamp is put in place in the housing, one of the two or more present locking means in the housing can be selected, depending on the type of cable to be clamped. This way, the position of the cable clamp can selectively be adjusted between at least two alternative clamping positions so it can be used for more than one cable diameter.

Optionally, the housing comprises at least two slots, each being dimensioned to interlock a locking means formed by a matching extension of the cable clamp. Alternatively, the clamp can be provided with one or more slots dimensioned to cooperate with one or more matching interlocking means, such as hooks or projections, of the housing.

With only one slot of the two or more slots being used, the slots which have not been brought into engagement with the matching cable clamp extension, can for example be covered by a foil of electromagnetic shielding material. This prevents that the unused slot or slots forms a leak in the electromagnetic shielding. Alternatively, the slots can be replaced by blind holes.

The cable clamp extension forming the locking means comprise for example a hook.

To improve the grip of the cable clamp on the cable jacket, the intermediate portion of the cable clamp may be provided with one or more piercing teeth, e.g., piercing into the cable jacket. Optionally, the teeth may penetrate through the braid that has been folded back on the isolating jacket or sheath at the end of the cable, so as to bite into the isolating sheath so as to improve EMI shielding.

The intermediate portion can be provided with a flange bridging the gap between the intermediate portion and the adjacent edge of the cable receiving opening. The flange can be made of an electromagnetic shielding material.

In an alternative embodiment the intermediate cable clamp portion is provided with resilient teeth alternately folded in opposite directions. In use, the teeth resiliently clamp against the cable jacket. Such an arrangement of resilient teeth can effectively reduce freedom of forward movement of the clamped cable as well as backward movement.

In a further alternative embodiment, the intermediate section comprises at least two curved sections of different curving diameter. This way, the clamp can be used for stiffer cables having a diameter corresponding to one of the curved sections, and it can also be used for cables of larger diameter with higher compressibility.

An object of the invention is also achieved with a cable connector comprising a connector housing with an opening for receiving a cable, and a cable clamp mounted to the connector housing wherein the cable clamp comprises an intermediate section between two or more mounting portions, wherein the intermediate cable clamp portion is provided with resilient teeth alternately folded in opposite directions to resiliently clamp against the cable jacket. Optionally, the intermediate portion of the cable clamp is provided with a series of outwardly bent shielding teeth, to cover the gap between the intermediate portion and the interior edge or wall of the cable opening and to complete the electromagnetic shielding. These teeth may have rounded end parts, e.g., be mushroom shaped, to maximize coverage of the gap between the cable clamp and the cable opening.

DETAILED DESCRIPTION OF EMBODIMENTS

Figure 1:
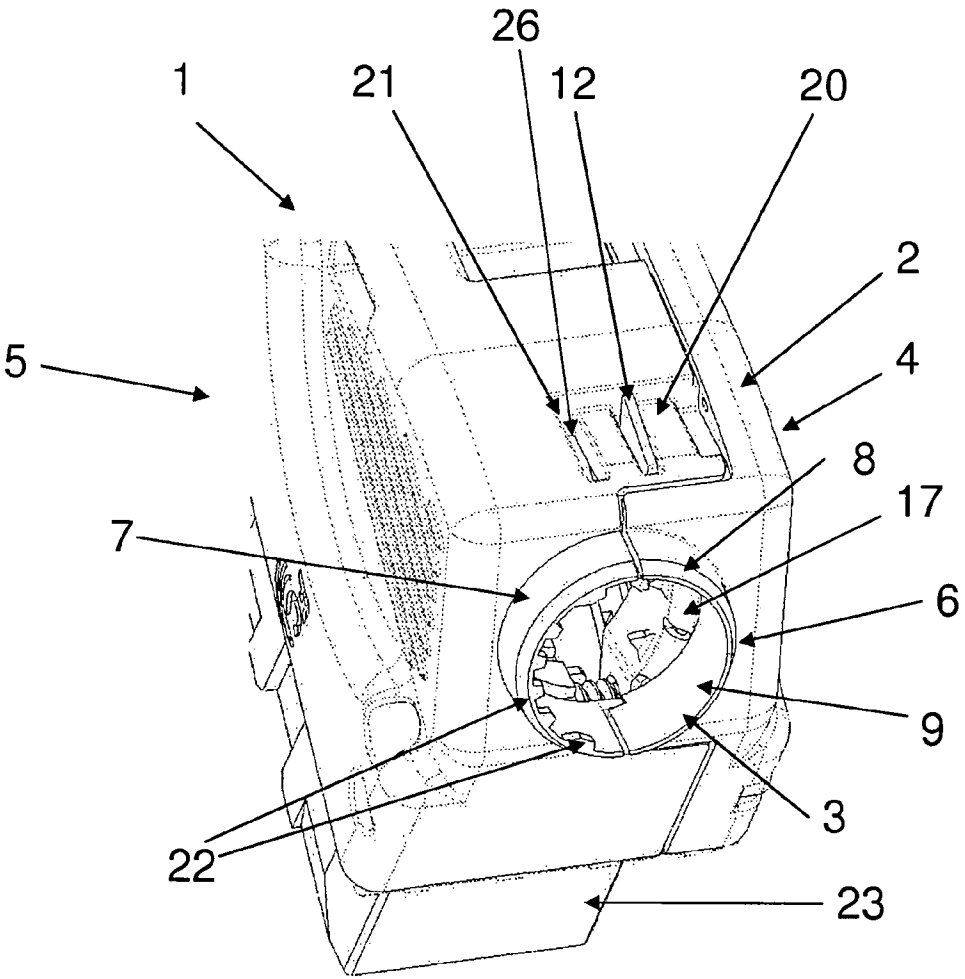
FIG. 1: shows in perspective view a connector according to the present invention.

FIG. 1 shows in perspective view a cable connector 1 comprising a connector housing 2 and a cable clamp 3 for clamping a cable (not shown) to the housing 2.

The housing 2 is made of two matching casing sections 4, 5 both comprising a semi-circular collar section 6, 7 together forming a cylindrical collar 8 when both casing sections 4, 5 are joined together to form the housing 2. FIG. 2 shows the interior of the connector 1 with the shell section 5 broken away. The collar 8 surrounds an opening 9 in the housing 2 for receiving a cable. In line with the collar 8 located within the housing 2 is a cable clamp 3, which is shown in more detail in FIGS. 3A-C.

The cable clamp 3 comprises a first mounting portion 11, a second mounting portion 12 aligned with respect to the first mounting portion, and a curved intermediate portion 13. The first mounting portion 11 has a rounded end and comprises an opening 14 allowing passage of a fixation screw, as shown in FIG. 2. According to a preferred embodiment, the second mounting portion is provided with a bend portion or makes an angle with respect to the first mounting portion in order to make the mounting step easier.

The second mounting portion 12 forms a locking means provided with a slanting top edge 15.

The curved intermediate portion 13 has a concave side provided with five evenly distributed triangular teeth 16. On its convex side, the clamp 3 is provided with a collar or flange 17. To facilitate bending the flange 17, openings or slots 18 are provided on the folding line 19 of the flange 17.

The clamp 3 and the housing 2 are made of an electromagnetic shielding material.

The top side of the housing 2 is provided with locking means formed by slots 20, 21, both dimensioned to receive locking means 12 of the cable clamp 3. When the locking portion 12 is put into the first slot 20, the clamp leaves open a larger opening for passage of a cable than if portion 12 is put into the second slot 21. As a result, cables of different diameter can be clamped using the same cable clamp 3. If a smaller diameter cable is used, the cable clamp portion 12 is brought into engagement with slot 21. In that position, flange 17 covers the gap between the curved clamp portion 13 and the housing wall surrounding cable opening 9. Flange 17 can be made of an electro conductive material. The interior wall of the housing facing the flange 17 can be provided with projections or teeth contacting flange 17. This way, flange 17 completes the electromagnetic shielding of the connectors interior.

When a cable is clamped in the opening 9 by clamp 3, the triangular teeth 16 pierce into the cable jacket to give improved fixation of the cable. Optionally, the teeth penetrate through the braid that has been folded back on the isolating jacket or sheath at the end of the cable, so as to bite into the isolating sheath so as to improve EMI shielding. Alternatively, the teeth penetrate through the isolating sheath to such extent that it contacts the underlying conductive shielding braid.

Slots 20, 21 may be dimensioned to limit passage of electromagnetic wavelengths above a particular cut-off wavelength of electromagnetic noise, corresponding to a lower frequency limit for EMI noise. Optionally, slots 20, 21 can be sealed with a foil 26 of an electromagnetic shielding material. When the clamp portion 12 is brought into engagement with one of the slots, the corresponding seal is broken while the other slot remains sealed.

The slanting edge 15 of cable clamp portion 12 juts out off the slot 20, 21, allowing visual inspection, particularly if the portion 12 and the housing 2 have different colours, shades or brightness.

The opening 9 in housing 2 is provided with ribs or protrusions or teeth 22 to further reduce movement of the cable.

The cable to be used comprises electro conductive wires to be connected to contact points in a terminal block 23 closing off the housing 2.

Figure 2B:
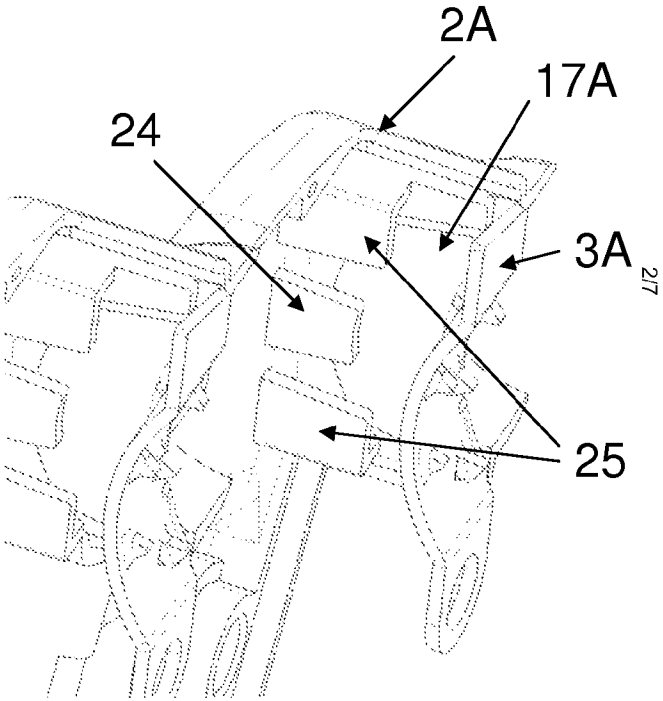
FIG. 2B: shows in perspective view a multi-connector variant of the connector of FIG. 2A.
Figure 2A:
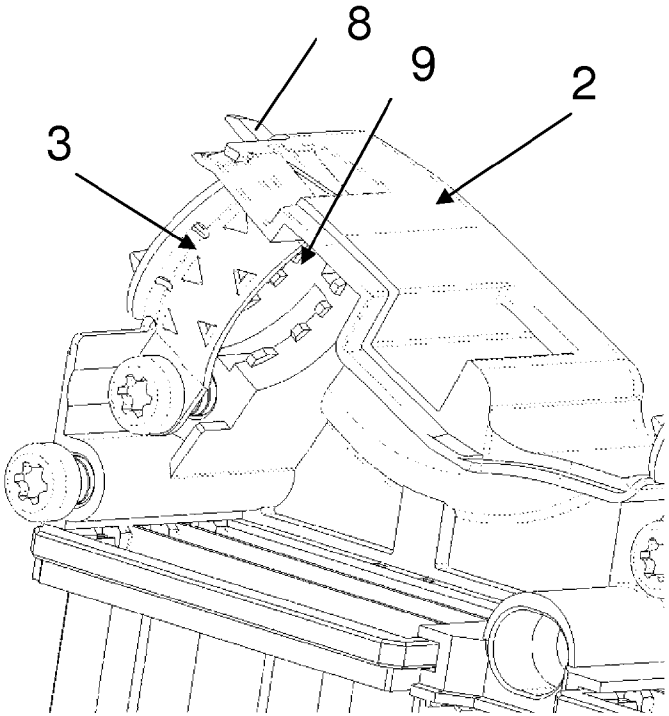
FIG. 2A: shows in perspective view the interior of the connector of FIG. 1.
Figures 3A, 3B, 3C:
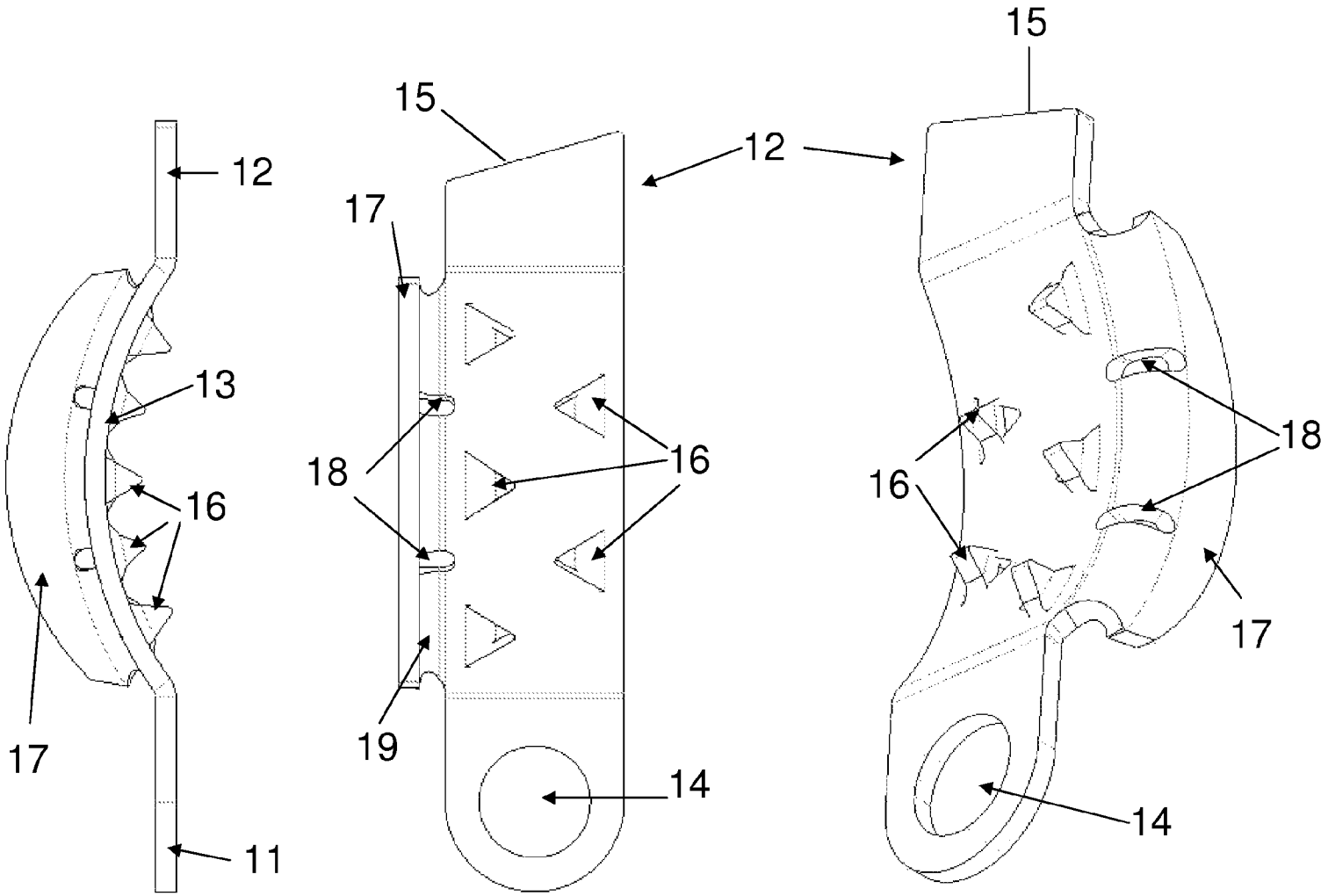
FIG. 3A: shows a side view of the cable clamp of FIG. 1.
FIG. 3B: shows a plan view of the cable clamp of FIG. 1.
FIG. 3C: shows a perspective view of the cable clamp of FIG. 1.

In FIG. 2B, a double connector is shown comprising a cable clamp 3A similar to the cable clamp in FIG. 2A but with a larger flange 17A. A resilient fin 24 presses the flange 17A against the interior housing surface peripheral to the cable opening. Corner parts 25 with an L-shaped cross section surround the two side edges of the flange 17A, protecting the fin 24 from breaking when a certain force is exercised onto the cable and the cable clamp in the direction of fin 24.

A set of different exchangeable cable clamps can be used having different sizes of flanges. Clamps for cables of smaller diameter have to bridge a larger gap between the clamp and the cable opening edge and can for that purpose be provided with larger flanges. A set can for instance include the clamp 3 of FIG. 2A and the clamp 3A of FIG. 2B and optionally further type variations, wherein each clamp type can be used for two or more corresponding cable diameters.

Figure 4:
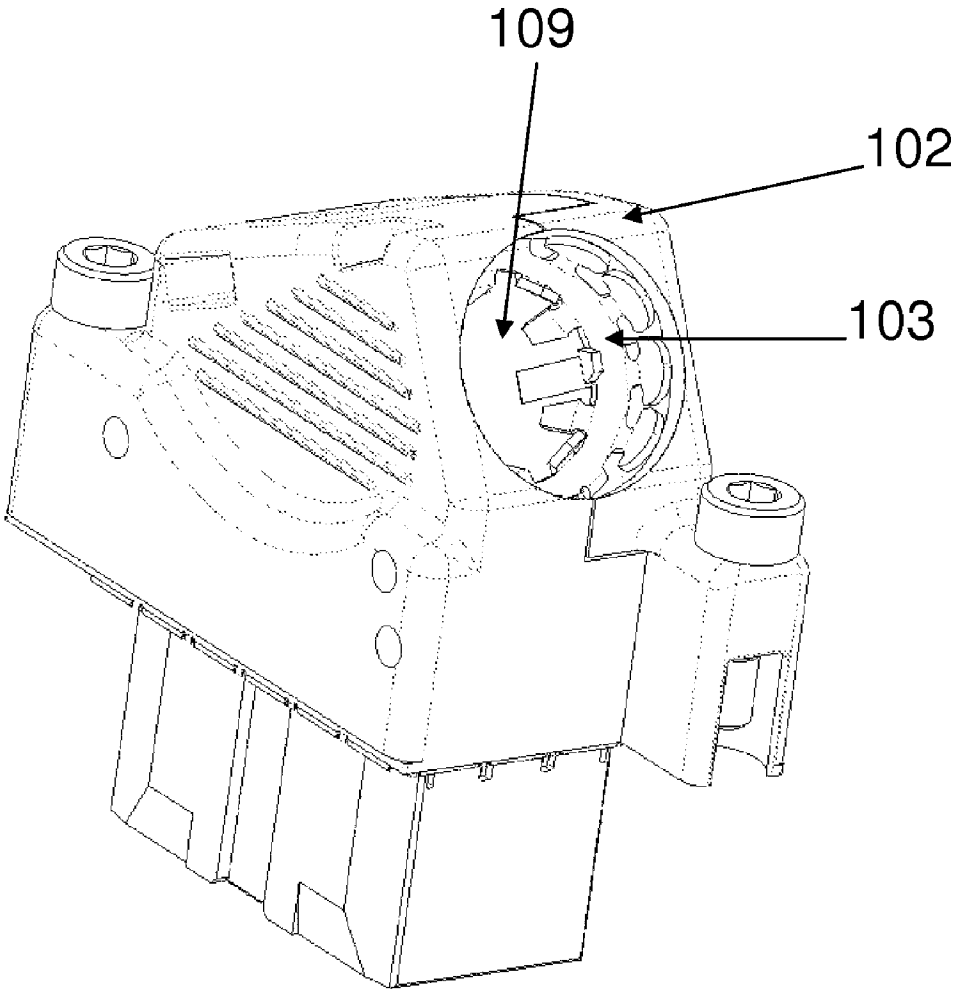
FIG. 4: shows a perspective view of a second embodiment of a connector according to the invention.
Figure 5B:
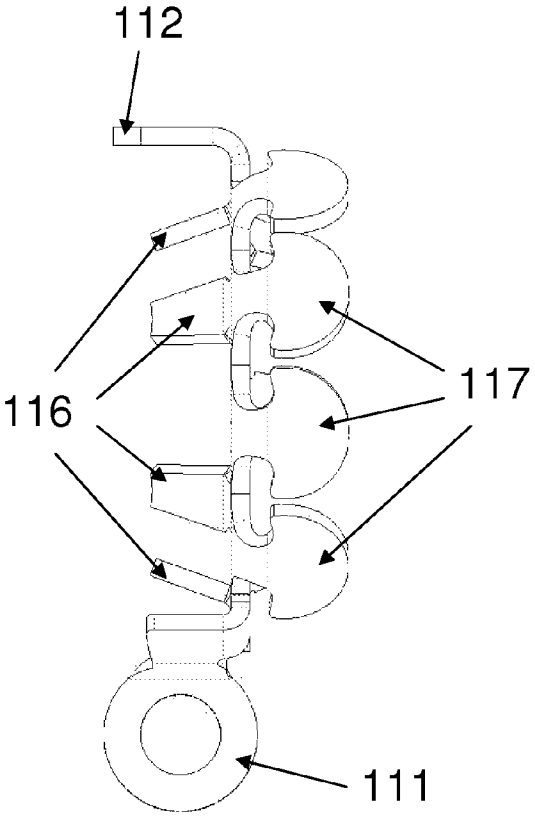
FIG. 5B: shows a side view of the cable clamp of FIG. 5A.
Figure 5A:
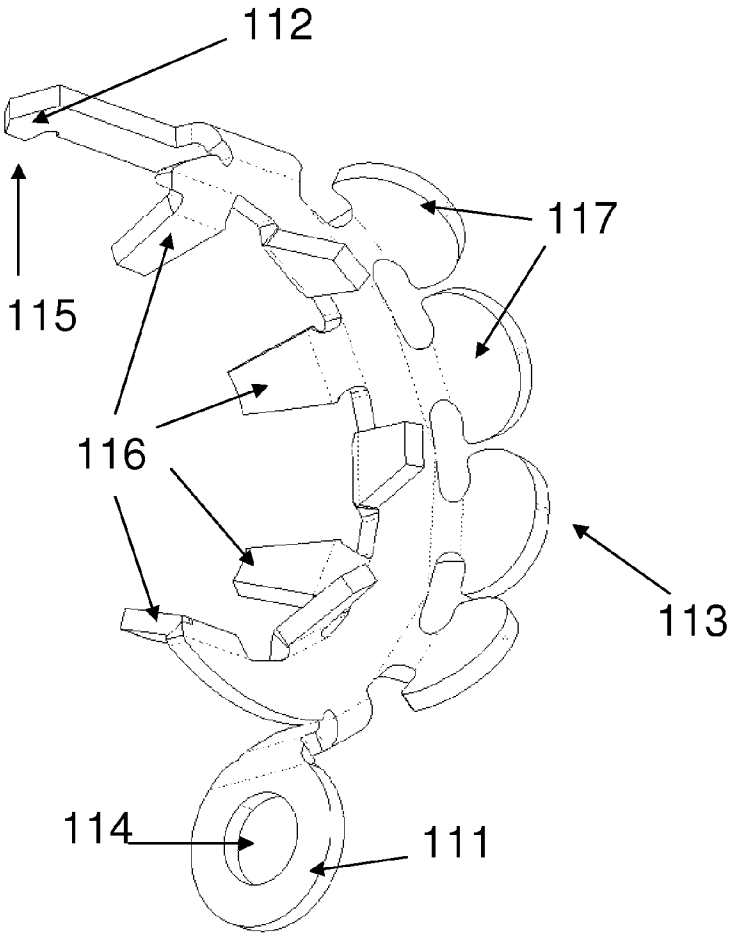
FIG. 5A: shows a perspective view of a cable clamp of the connector of FIG. 4.

Another embodiment of a cable clamp 103 according to the present invention is shown in FIGS. 4 and 5A and 5B.

FIG. 4 shows a housing 102 with an opening 109 for receiving a cable. In line with the opening 109 is a cable clamp 103, shown in detail in FIGS. 5A and 5B. The cable clamp 103 comprises a first portion 11 with an opening 114 allowing passage of a fixation screw, a second portion 112 provided with a hook 115, and a curved intermediate portion 113. End portions 111 and 112 are bent over right angles with the intermediate portion 113. On its concave side, the curved intermediate portion 113 is provided with teeth or leaf springs 116 alternately bent in opposite directions. The convex side of the curved portion 113 is provided with a series of mushroom shaped projections 117, bent under an angle of about 60-70 degrees relative to the intermediate portion 113.

When mounted in a connector housing and after connecting a cable to the connector, hook 115 of portion 112 is brought into engagement with a corresponding slot in the housing 2 and a fixation screw fixes the clamp via opening 114 in end portion 111. Teeth 116 resiliently clamp on the cable. Due to the alternating orientation of the teeth backward as well as forward movement of the cable is effectively reduced. The mushroom shaped projections 117 resiliently engage with the interior wall of opening 109, effectively bridging the gap between the cable clamp 113 and the interior wall of opening 109 and completing the electromagnetic shielding. The resiliency of the mushroom shaped projections 117 increases the range of cable diameters that can be used with the cable clamp 103.

Figure 6B:
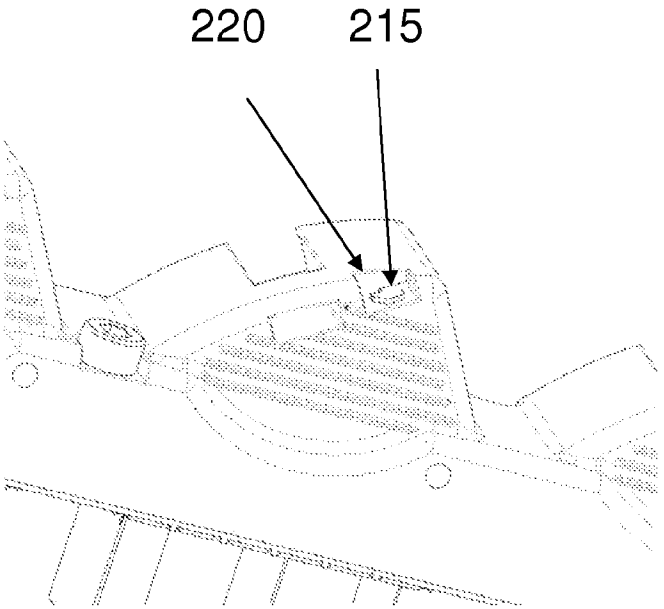
FIG. 6B: shows another perspective view of the connector of FIG. 6A.
Figure 6A:
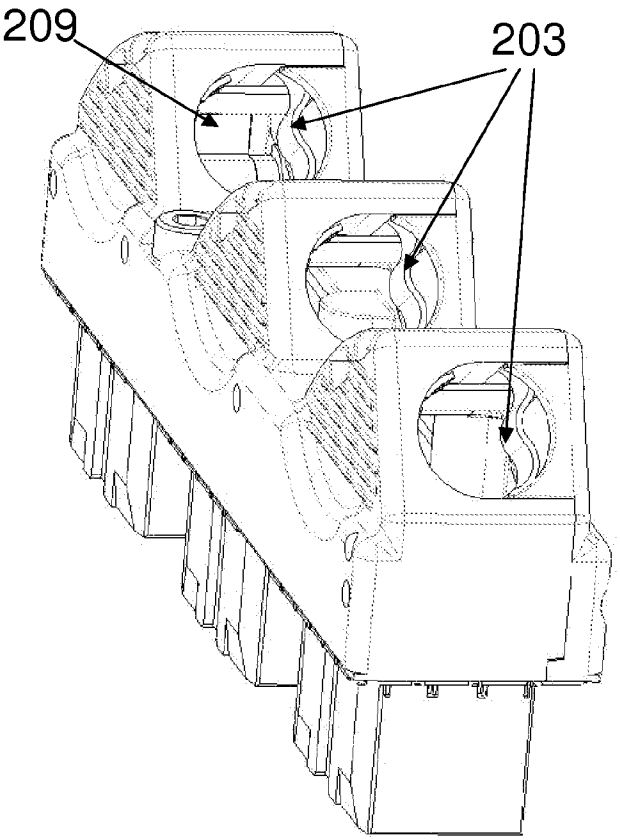
FIG. 6A: shows a perspective view of a third embodiment of a connector according to the invention.
Figure 7B:
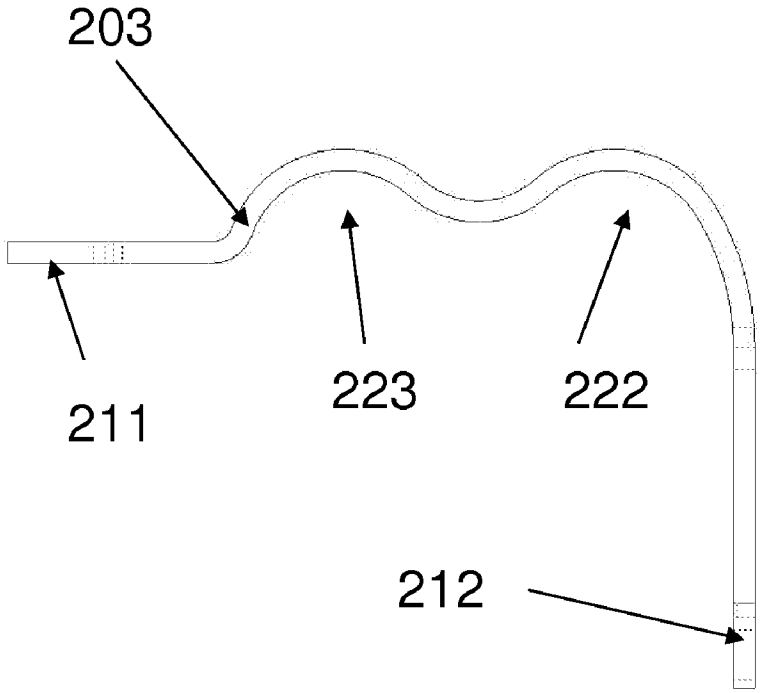
FIG. 7B: shows a side view of the cable clamp of FIG. 7A.
Figure 7A:
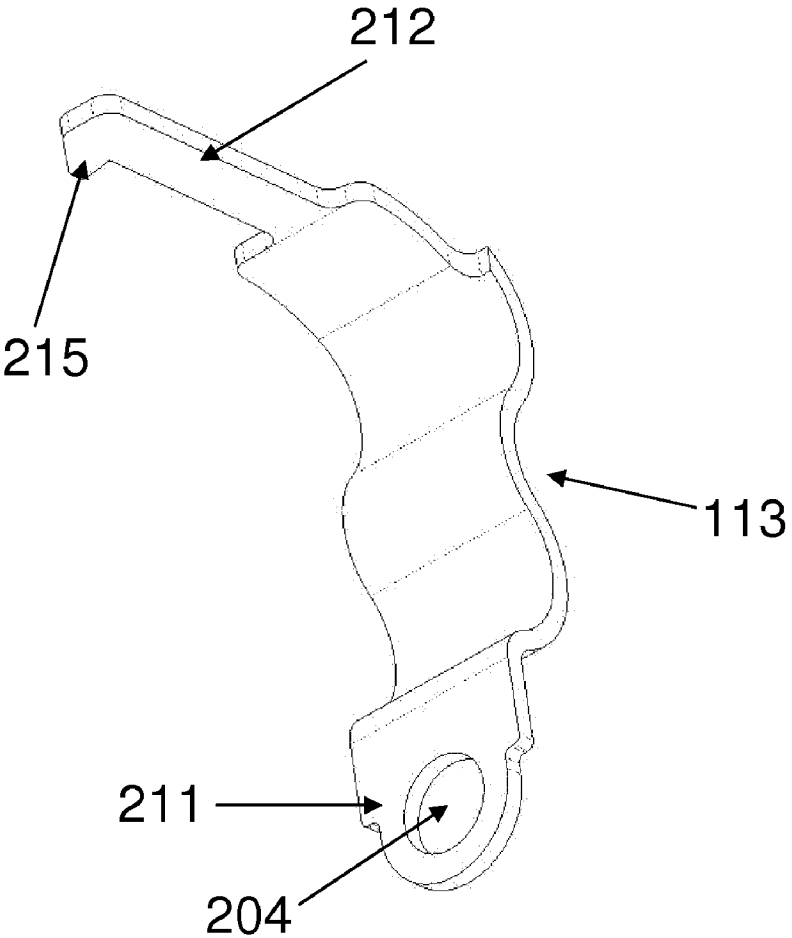
FIG. 7A: shows a perspective view of the cable clamp of the connector of FIG. 6A.

A third embodiment of a cable clamp 203 according to the invention is shown in FIGS. 6A-7B. FIG. 6A shows a triple cable connector having three cable openings 209 and cable clamps 203. As shown in detail in FIG. 7A, the cable clamps 203 are provided with a first end portion 211 with an opening 204 for a fixation screw or similar fastening means, and a second end portion 212 with a hook 215. As shown in FIG. 6B, hook 215 is mounted in a corresponding slot 220 in housing 202 of the connector. The cable clamp 203 has a curved intermediate section 213 having a profile with two rounded bulges of different diameter. Such a clamp can be used for stiffer cables having a diameter corresponding to either one of the bulges 222, 223, but also for more compressible cables with a larger diameter.

The described embodiments are intended to be illustrative rather than restrictive. Various modifications, variations and re-combinations of features of the embodiments as described can be made without departing from the spirit or scope of the disclosure.

The invention claimed is:

1. Cable connector comprising a connector housing with an opening for receiving a cable, and a cable clamp mounted to the connector housing, wherein the cable clamp comprises an intermediate section between two or more mounting portions, a first one of the mounting portions comprising locking means for interlocking with cooperative locking means of the housing, wherein cables of different diameter can be clamped by said cable clamp, wherein a second one of the two or more mounting portions of the cable clamp is configured to be fixedly attached to a portion of the housing with a threaded fastener, wherein the locking means of the connector housing comprises at least one through slot, the through slot being dimensioned to interlock the locking means of the cable clamp.

2. Cable connector according to claim 1 wherein the slot comprises a foil of an electromagnetic shielding material.

3. Cable connector according to claim 1 wherein the cable clamp locking means comprises a hook.

4. Cable connector according to claim 1 wherein the intermediate portion of the cable clamp is provided with piercing teeth.

5. Cable connector according to claim 1 wherein the intermediate portion is provided with a flange bridging a gap between the intermediate portion and an adjacent edge of the opening.

6. Cable connector according to claim 1 wherein the intermediate cable clamp portion is provided with resilient teeth alternately folded in opposite directions to resiliently clamp against the cable jacket.

7. Cable connector according to claim 1 wherein the intermediate section comprises at least two curved sections of different curving diameter.

8. Cable clamp for a cable connector according to claim 1.

9. A cable connector comprising:

a connector housing comprising an opening and a first through slot, wherein the opening is adapted to receive a cable; and a cable clamp comprising a first mounting portion and a second mounting portion, wherein the cable clamp is adapted to be alternatively connected to the housing in a first position and a second position;

wherein when the clamp is connected to the housing in the first position, the first mounting portion is fixedly attached to a portion of the housing and the second mounting portion is at the first through slot;

wherein when the clamp is connected to the housing in the second position, the first mounting portion is attached to the portion of the housing, and wherein the first mounting portion is configured to be fixedly attached to the portion of the housing with a threaded fastener when the clamp is connected to the housing in the first and second positions.

10. A cable connector as in claim 9 wherein the first position corresponds to a first cable diameter, and wherein the second position corresponds to a second different cable diameter.

11. A cable connector as in claim 9 wherein the first through slot comprises a foil of an electromagnetic shielding material.

* * * * *